US008388503B2

(12) United States Patent
Buzzanco et al.

(10) Patent No.: US 8,388,503 B2
(45) Date of Patent: Mar. 5, 2013

(54) SAFETY CIRCUIT FOR A MARTIAL ARTS PRACTICE DUMMY

(76) Inventors: Joseph E. Buzzanco, Girard, PA (US); Lawrence A Slomski, Saegertown, PA (US); James R Schmitt, Edinboro, PA (US)

( * ) Notice: Subject to any disclaimer, the term of this patent is extended or adjusted under 35 U.S.C. 154(b) by 0 days.

(21) Appl. No.: 13/246,807

(22) Filed: Sep. 27, 2011

(65) Prior Publication Data

US 2012/0065031 A1 Mar. 15, 2012

Related U.S. Application Data

(63) Continuation of application No. 12/583,404, filed on Aug. 19, 2009, now Pat. No. 8,025,612.

(51) Int. Cl.
*A63B 21/00* (2006.01)

(52) U.S. Cl. ..... 482/83; 482/90; 482/4
(58) Field of Classification Search ..... 482/83, 482/90, 4
See application file for complete search history.

(56) References Cited

U.S. PATENT DOCUMENTS 7,628,730 B1 * 12/2009 Watterson et al. ..... 482/8

* cited by examiner

*Primary Examiner* — Jerome w Donnelly
(74) *Attorney, Agent, or Firm* — Richard K Thomson

(57) ABSTRACT

Several embodiments of martial arts practice assemblies are described involving variations spanning from apparatus permitting movement along a single translational axis and about a single rotational axis to an embodiment mounted on a robotic arm enabling translation in all three axial directions and about all three rotational axes. A dual-lockout circuit requiring simultaneous activation by an operator and a user is used to activate the pneumatic system powering the assembly.

4 Claims, 17 Drawing Sheets

SAFETY CIRCUIT FOR A MARTIAL ARTS PRACTICE DUMMY

This application is a continuation of U.S. patent application Ser. No. 12/583,404 filed Aug. 19, 2009, now U.S. Pat. No. 8,025,612. The present invention is directed to the field of sports activity. More particularly, the present invention is directed to a manikin useful in the practice of martial arts.

BACKGROUND AND SUMMARY OF THE INVENTION

The present invention is directed to the field of sports activity. More particularly, the present invention is directed to a manikin useful in the practice of martial arts.

A number of prior art patents disclose martial arts practice dummies. For the most part, these devices are little more than punching bags which are shaped like a person. While several are mounted to permit reaction to punches/kicks, none realistically simulate the movements of a live opponent. It is among the objects of the present invention to address this defect by providing several embodiments of practice dummies which have an increasing number of degrees of motion which enable the dummies to simulate actual combatant-like movements. Actual practice dummies made in accordance with the teachings of the present application are available from Ultimate Fighting Partner, LLC of Edinboro, Pa.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF THE PREFERRED EMBODIMENT(S)

Figure 1A:
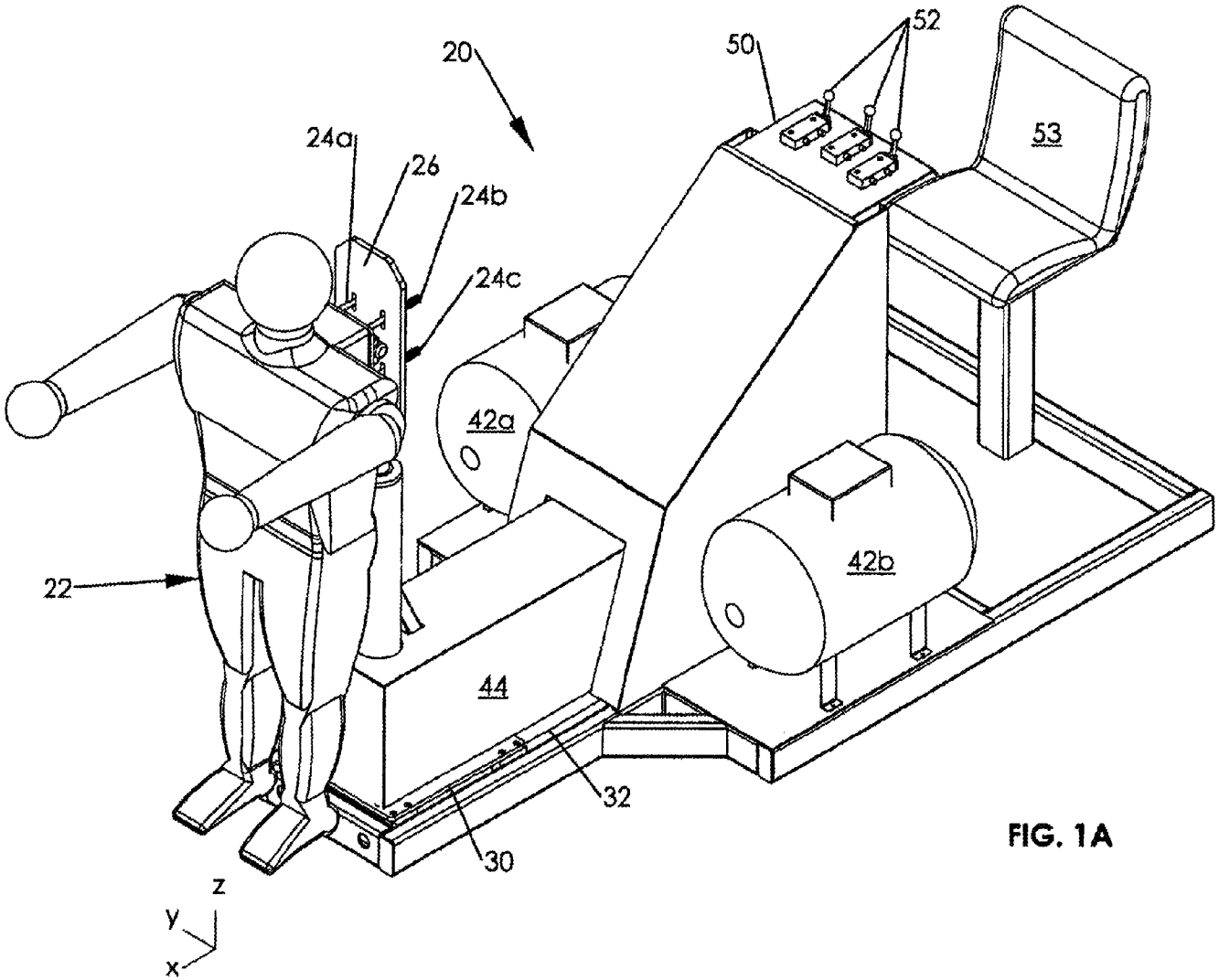
FIG. 1A is a perspective front view of a first embodiment of the practice dummy assembly of the present invention.
Figure 1B:
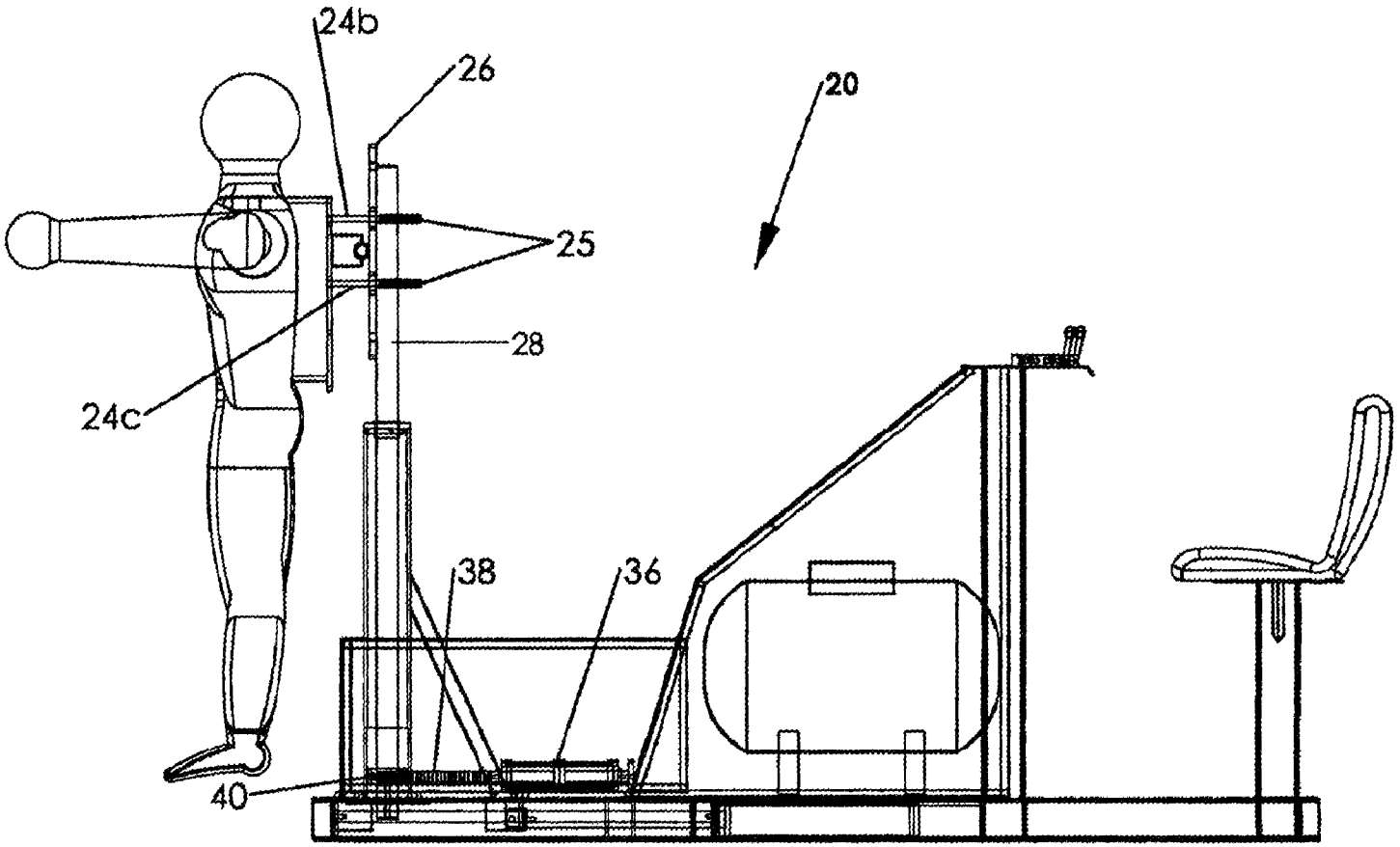
FIG. 1B is a schematic side view of the first embodiment.
Figure 1C:
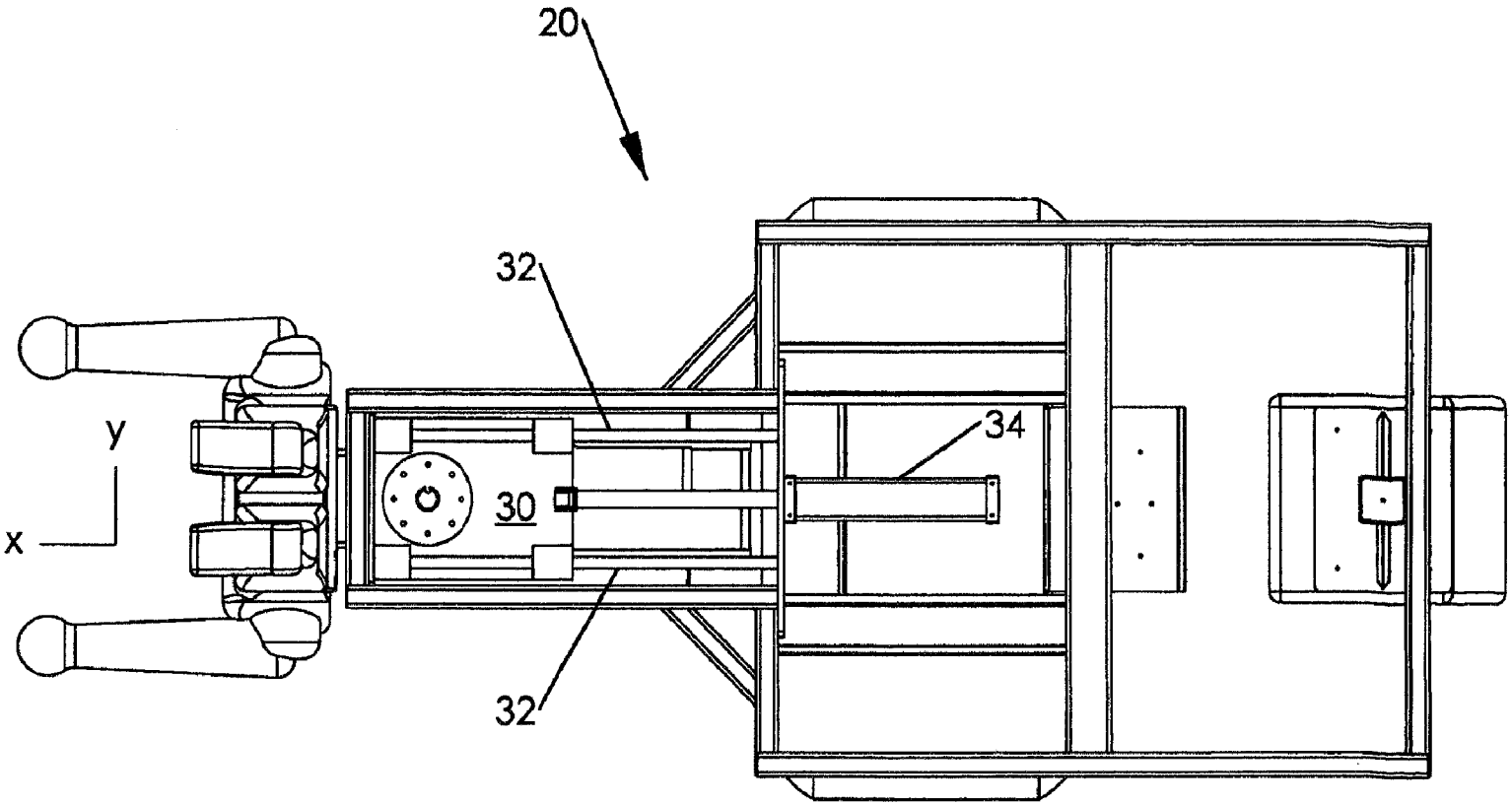
FIG. 1C is a bottom view of the first embodiment.

A first embodiment of the martial arts practice dummy assembly of the present invention is depicted in FIGS. 1A-1C generally at 20. Note, the housing in each of the schematic side views of the various embodiments are depicted as transparent in order to allow visibility of all operational equipment and provide an awareness of its location within the housing. Manikin 22 is made of a compressible elastomeric material, preferably a castable urethane foam. By way of example, a suitable material is available from Smooth-On, Inc. under the registered trademark Foam-It! 5. Manikin 22 is supported in a vertically upright position by four threaded rods 24*a*-24*d* which extend through support plate 26 mounted on shaft 28. Springs 25 on the ends of threaded rods 24*a*-24*d* provide some flexing in the mount when the user practices her/his kicks and punches. Shaft 28 is rotationally mounted on sled 30 which slides fore and aft on rails 32 (FIG. 1C) powered by pneumatic cylinder 34 to reposition manikin 22 translationally along longitudinal x-axis. A second cylinder 36 operates rack 38 which rotates pinion 40 on shaft 28 to pivot manikin 22 about a vertical z-axis. Pneumatic fluid is supplied from first storage tank 42*a* and second tank 42*b* which are pressurized by a compressor (not shown). First and second tanks 42*a*, 42*b* provide a level of redundancy for the pneumatic system, as well as ensuring adequate fluid pressure for all operations, particularly with respect to later embodiments. Housing shroud 44 surrounds the moving parts of the assembly 20 to prevent a user from accidentally getting tangled in the apparatus. Toggle switches 52 on control console 50 permits the operator sitting in chair 53 to adjust the fore-and-aft location of manikin 22 as well as rotating manikin about vertical z-axis by activating rack 38. The first embodiment 20 depicts the configuration of the existing working prototype.

Figure 2A:
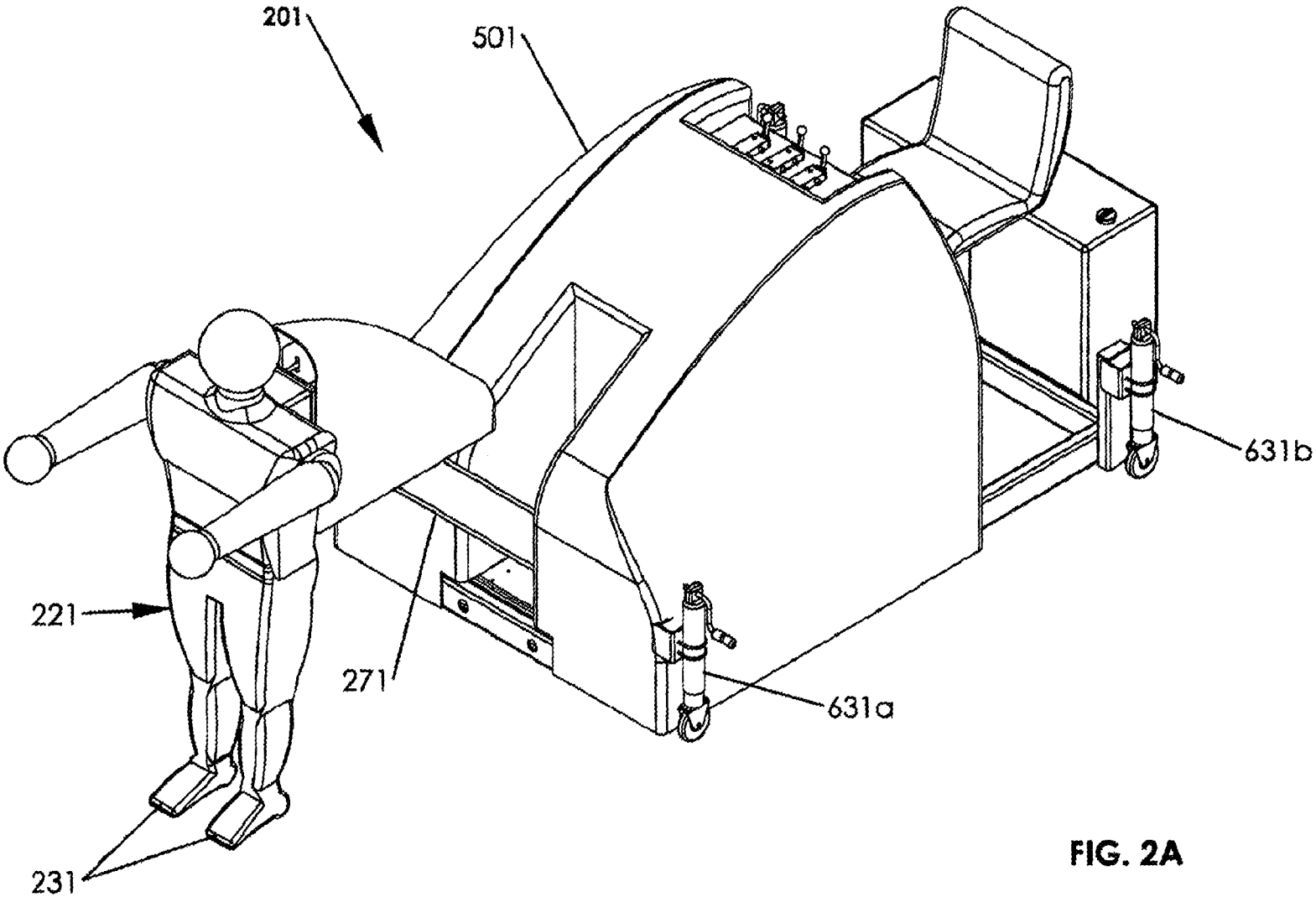
FIG. 2A is a perspective front view of a second embodiment.
Figure 2B:
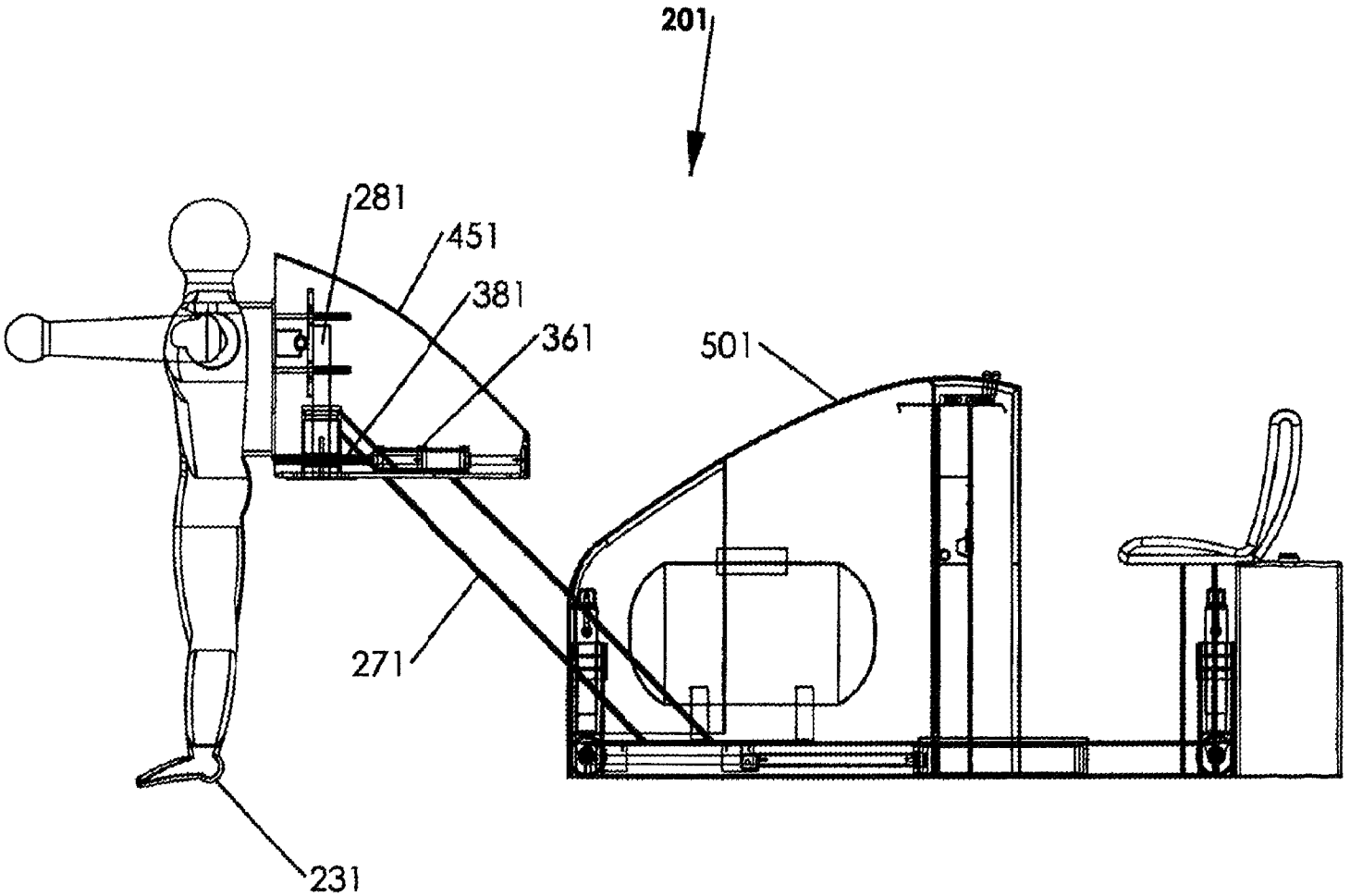
FIG. 2B is a schematic side view of the second embodiment.
Figure 2C:
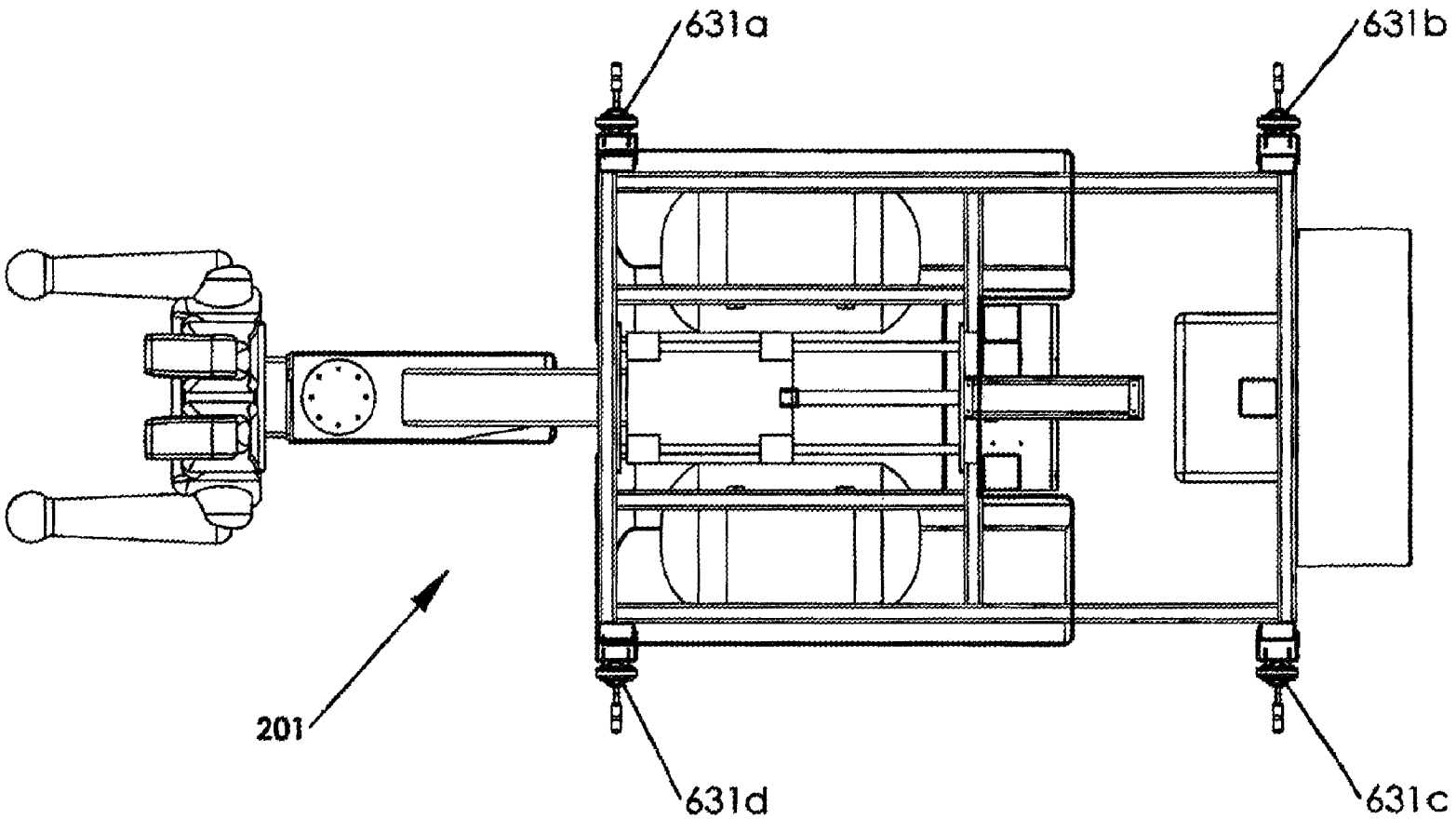
FIG. 2C is a bottom view of the second embodiment.
Figure 2D:
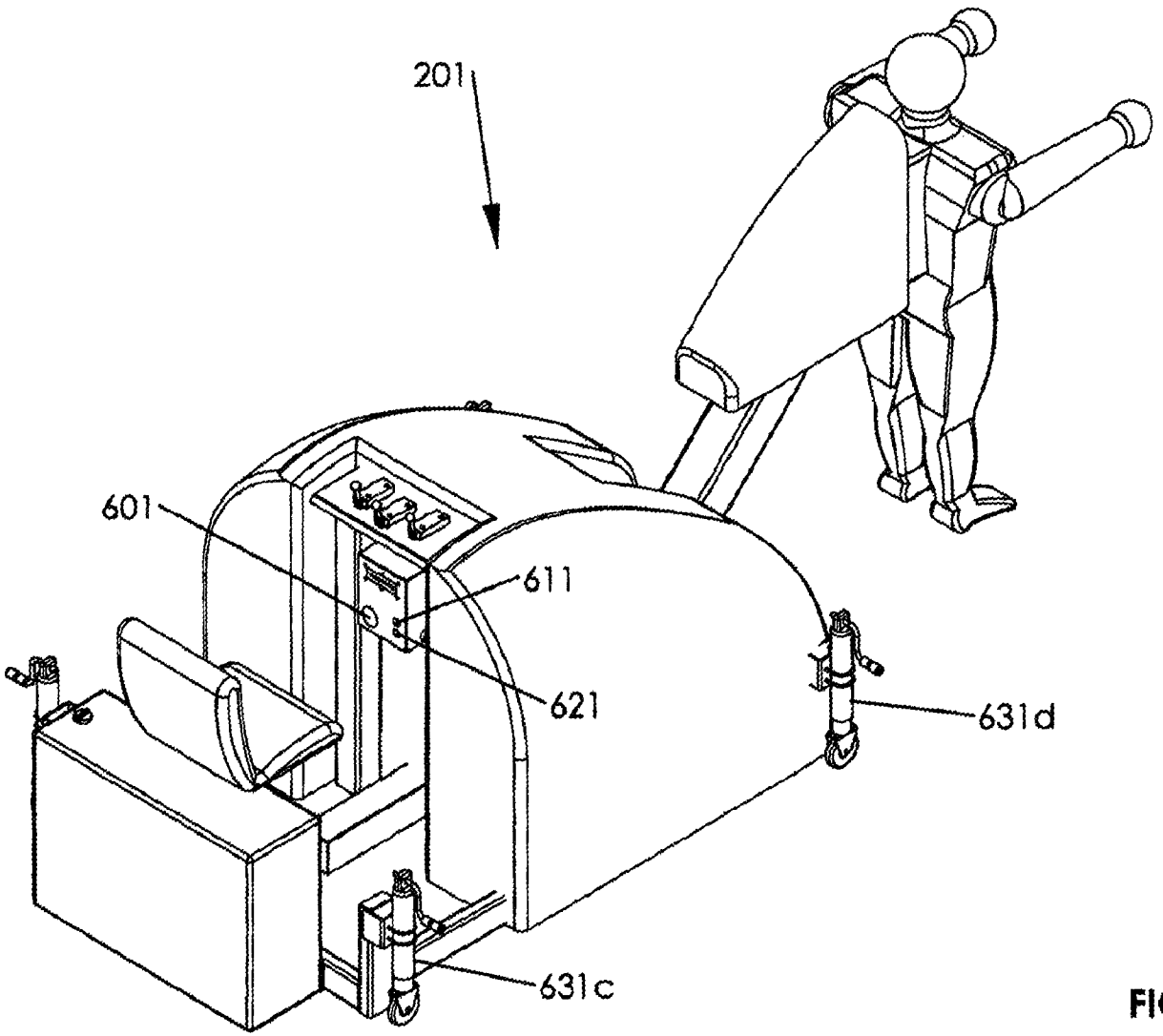
FIG. 2D is a rear perspective view of the second embodiment.

A second embodiment of the practice dummy assembly of the present invention is depicted in FIGS. 2A-2D generally at 201. In this embodiment, manikin 221 is mounted on a support arm 271. Support arm 271 is angled away from console 501 at a 45° angle to completely clear the feet 231 of manikin to enhance the user's experience by allowing the martial arts practitioner to work on leg sweeps, and similar related moves without fear of kicking the supporting structure. In this embodiment, the second cylinder 361 and rack 381 are housed within secondary shroud 451, with rotating shaft 281 being shortened to fit within shroud 451, as well (FIG. 2B). As best seen in FIG. 2D, a key operated switch 601 is located underneath the control console 501 along with on/off switches 611 and 621. This embodiment is equipped with four casters 631*a*-631*d* (FIG. 2C) which can be cranked into ground contact for mobilization and retracted when located where desired for stabilization.

Figure 3A:
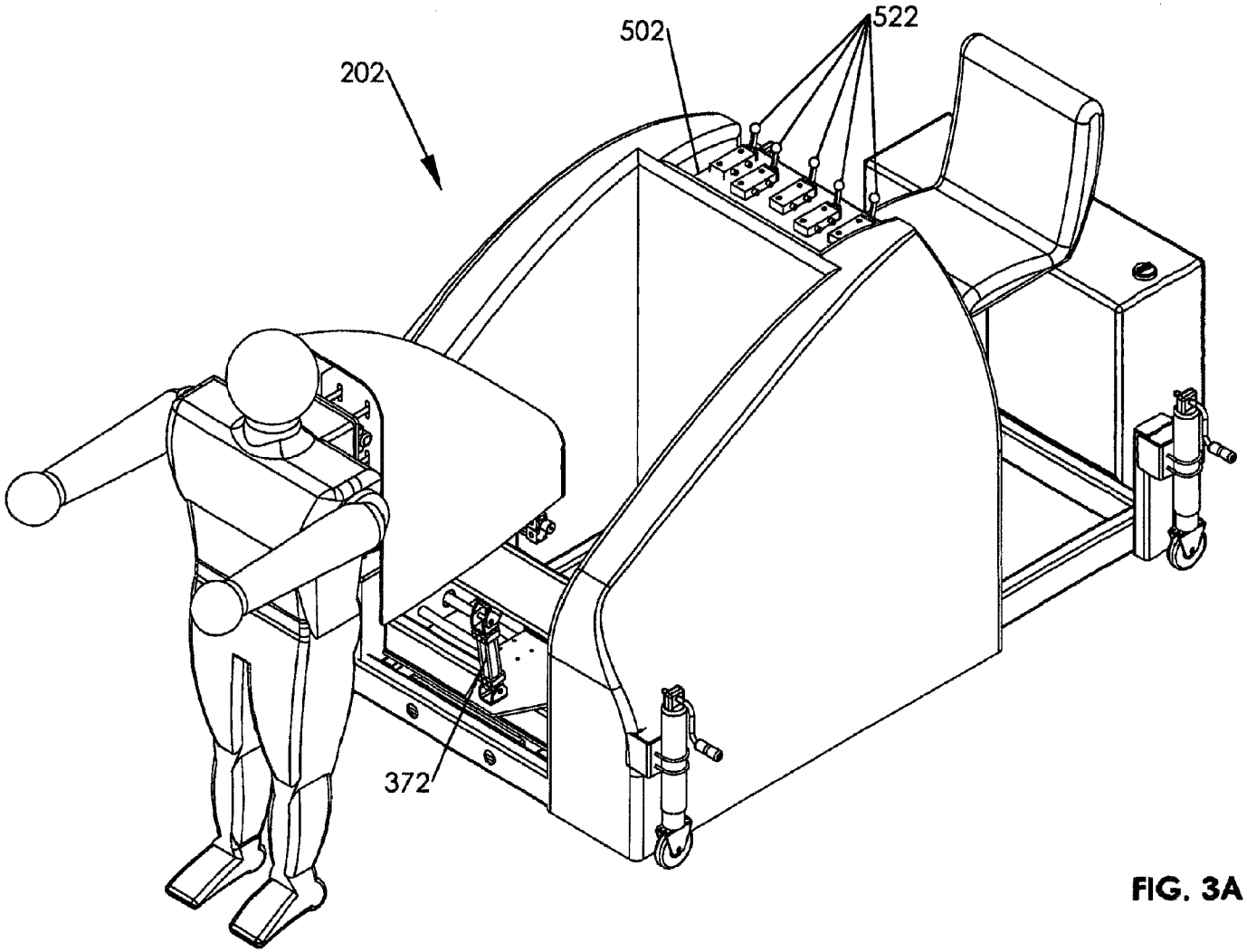
FIG. 3A is a front perspective view of the third embodiment.
Figure 3B:
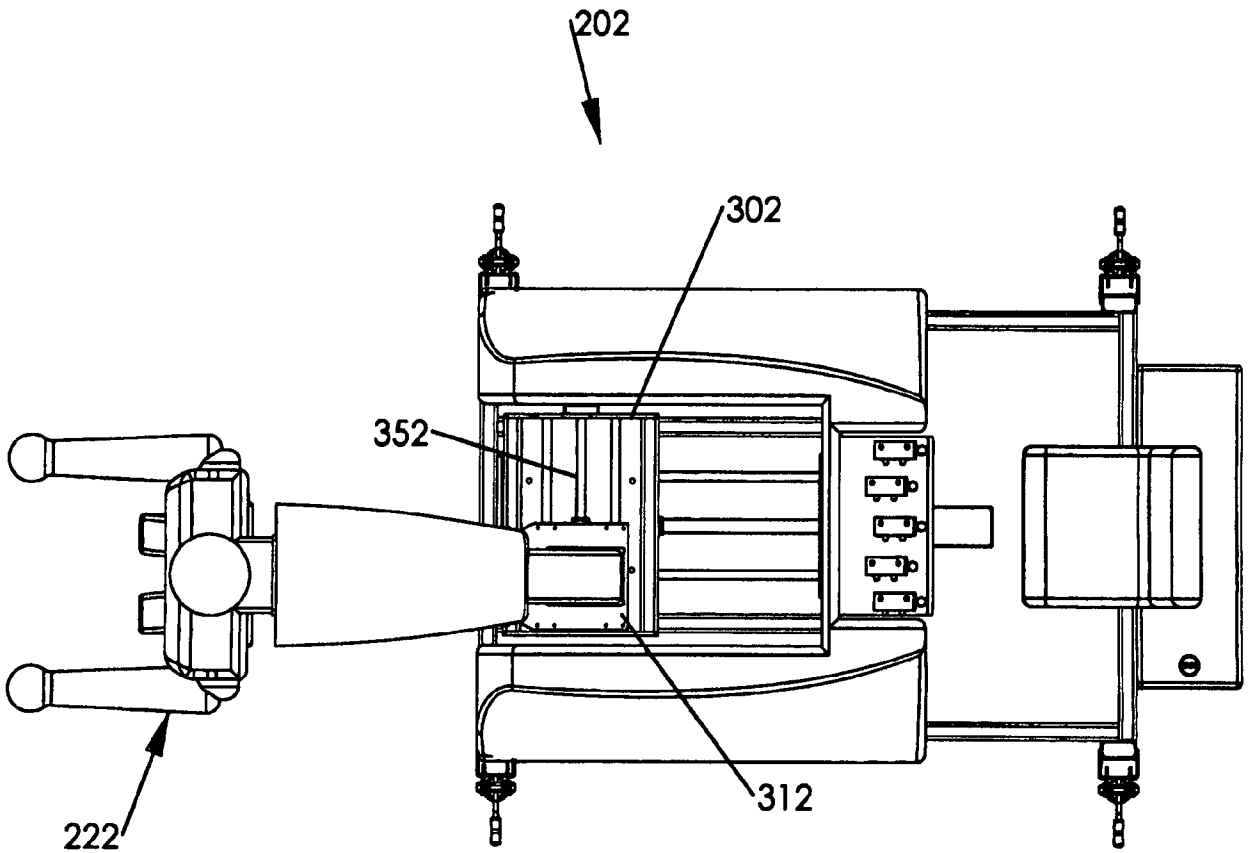
FIG. 3B is a top view of the third embodiment.

A third embodiment of the practice dummy assembly of the present invention is depicted in FIGS. 3A and 3B generally at 202. A transversely movable sled 312 is mounted on longitudinally movable sled 302 to add lateral movement capability to manikin 222. Sled 312 is repositioned laterally by cylinder 352 to move manikin 222 from side to side. Activation of vertically extending cylinder 372 causes manikin 222 to simulate a kicking motion. Additional toggles 522 have been added to control panel 502 to manually operate these additional cylinders 352 and 372.

Figure 4A:
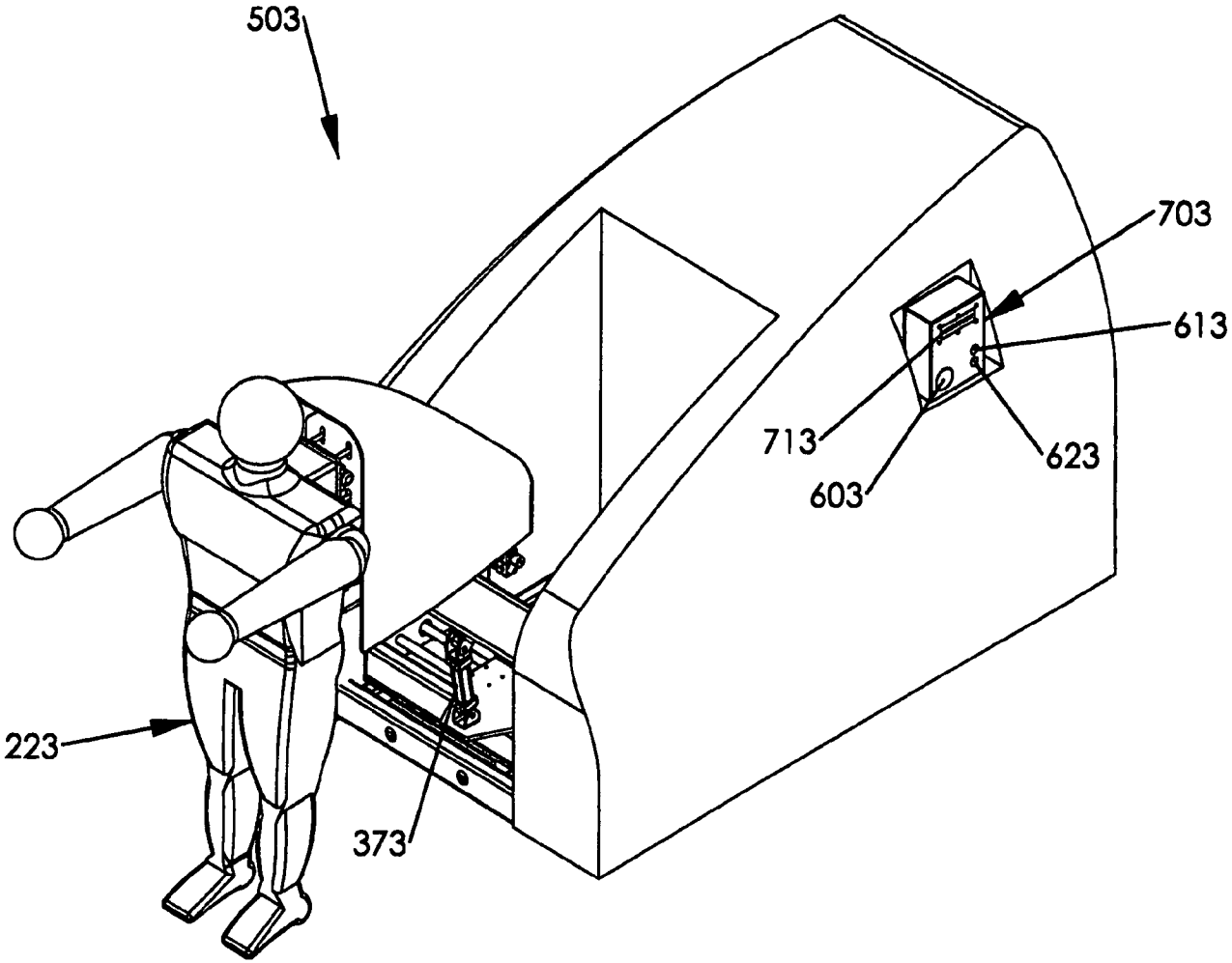
FIG. 4A is a front perspective view of the fourth embodiment.
Figure 4B:
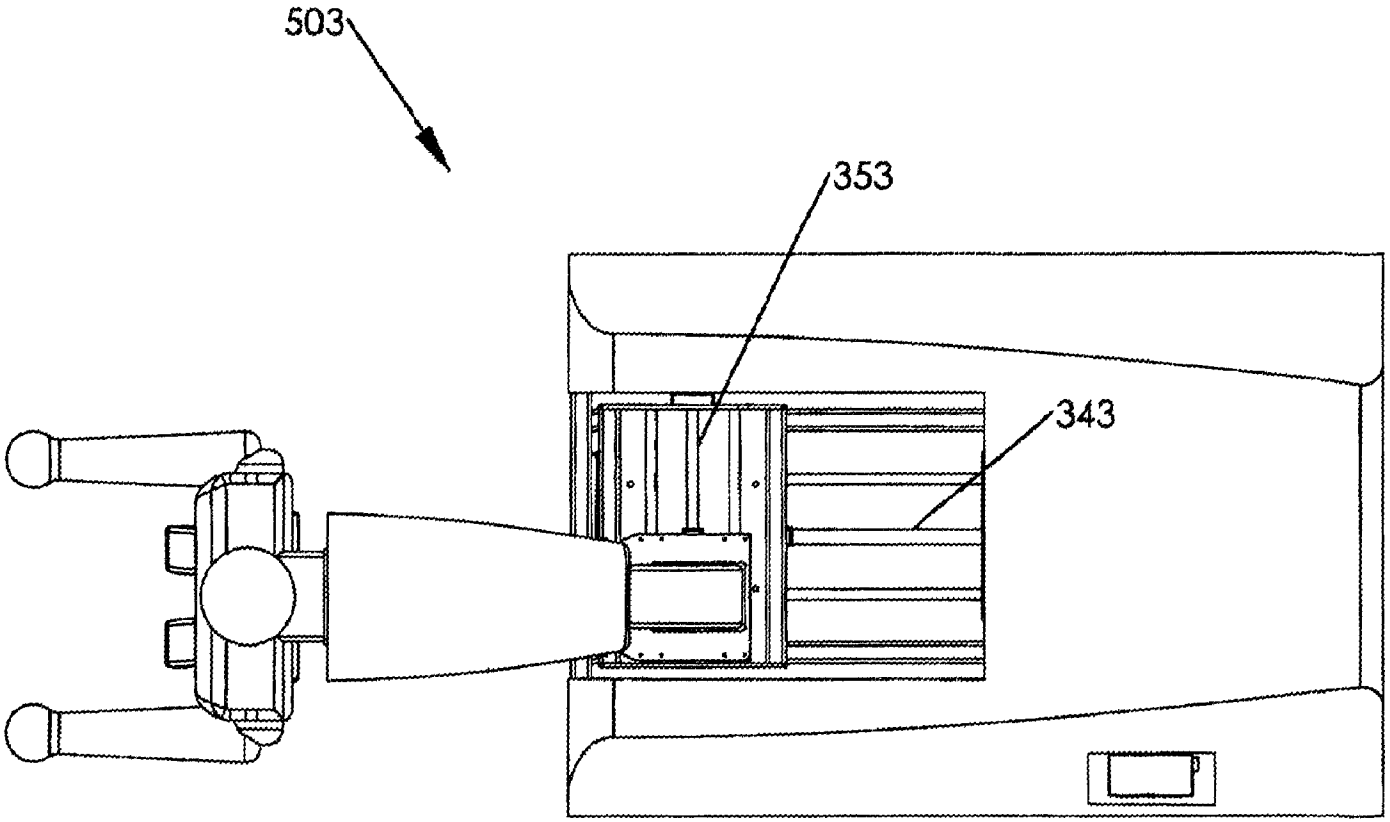
FIG. 4B is a top view of the fourth embodiment.
Figure 4C:
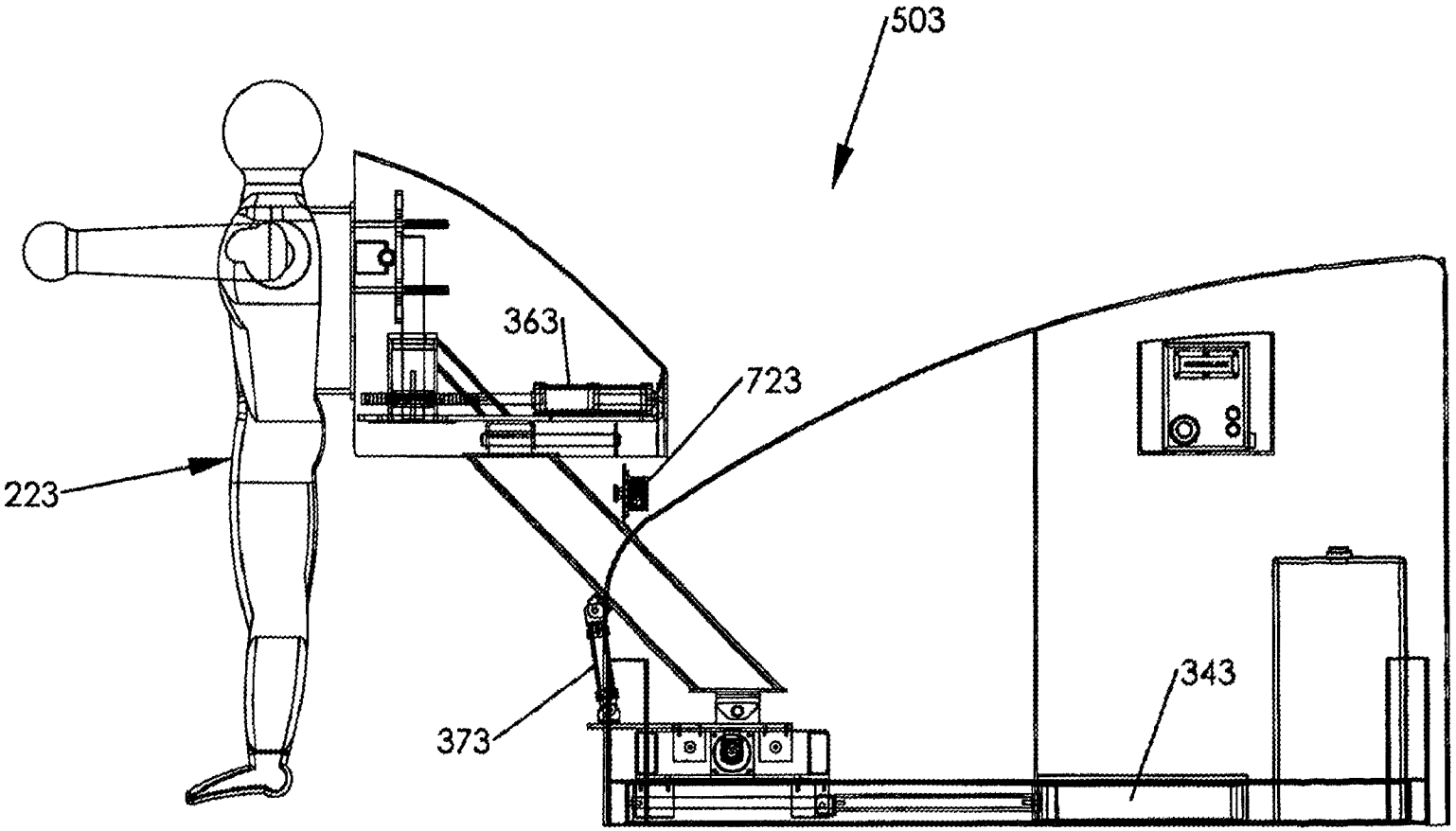
FIG. 4C is a side schematic view of the fourth embodiment.
Figure 5A:
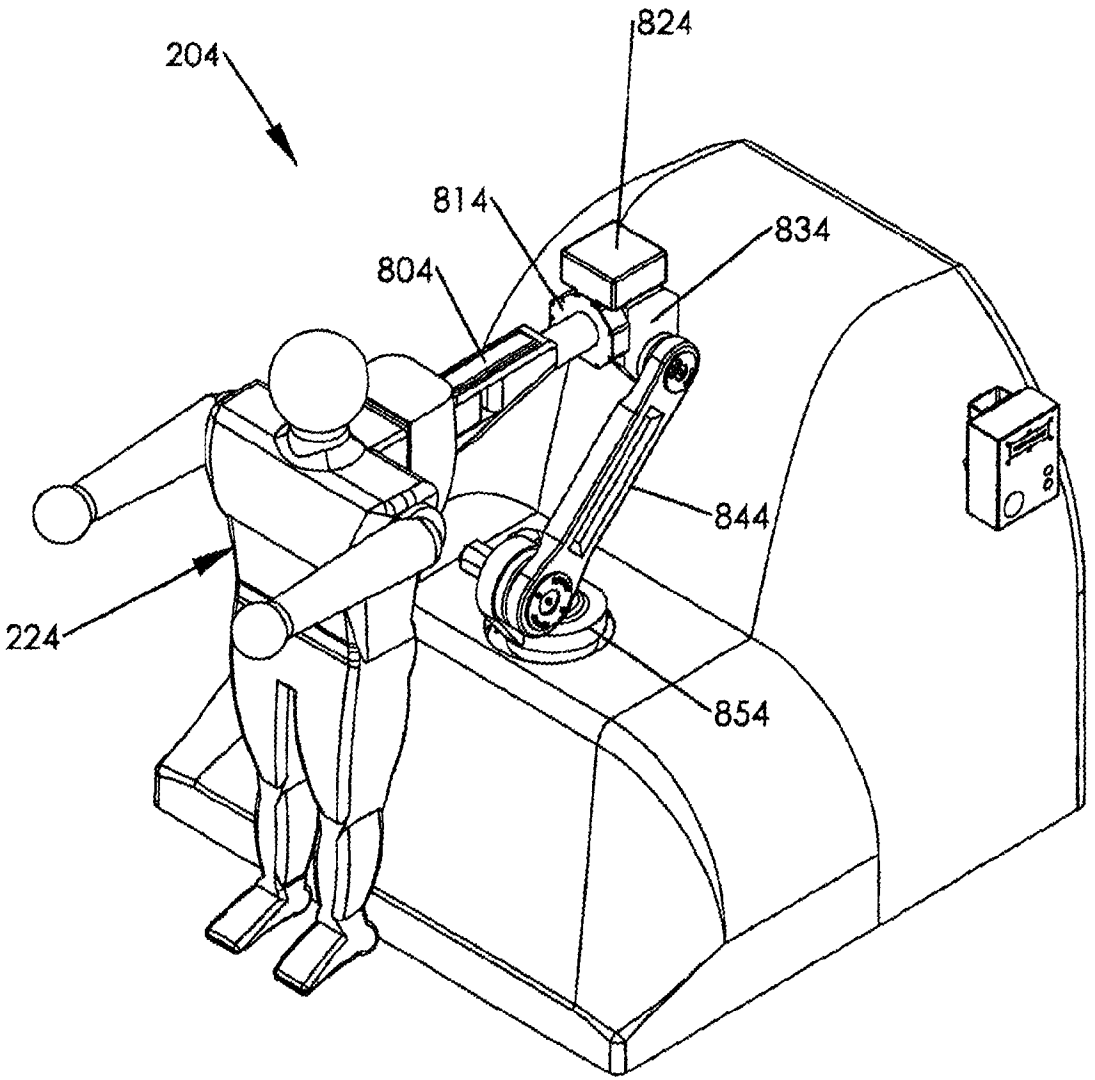
FIG. 5A is a front perspective view of the fifth embodiment.
Figure 5B:
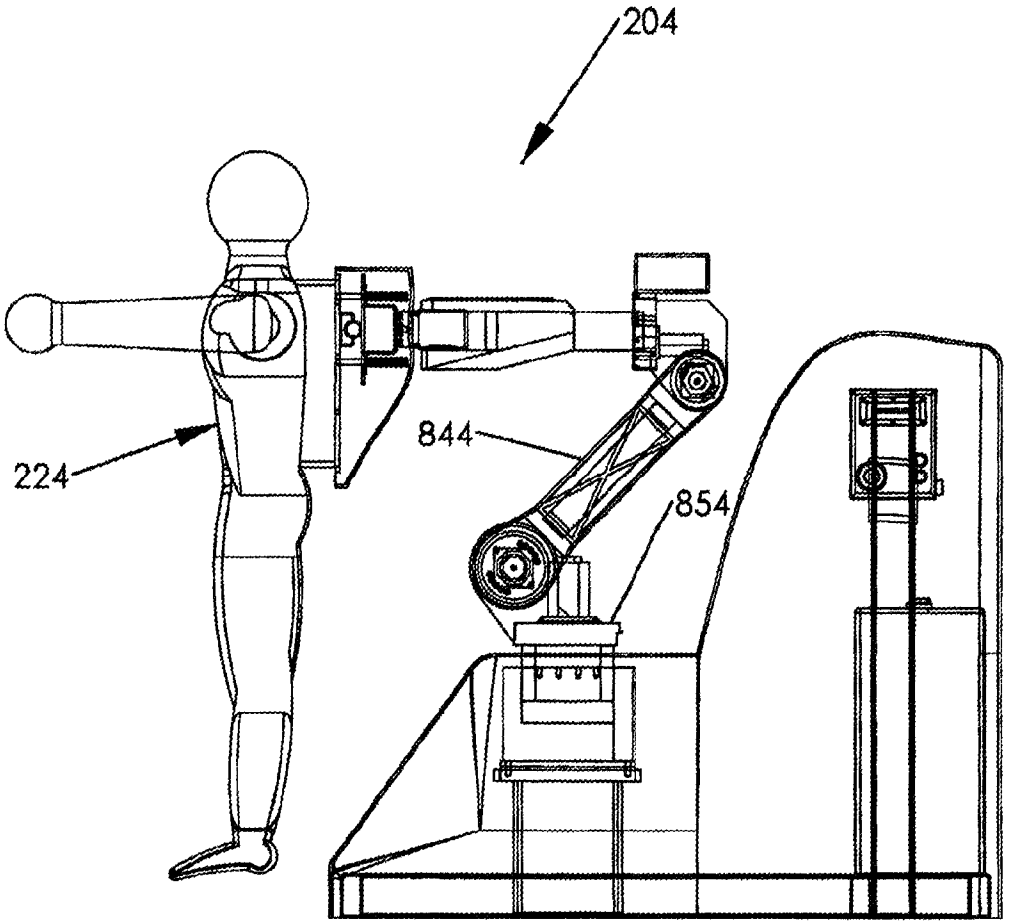
FIG. 5B is a side schematic view of the fifth embodiment.
Figure 5C:
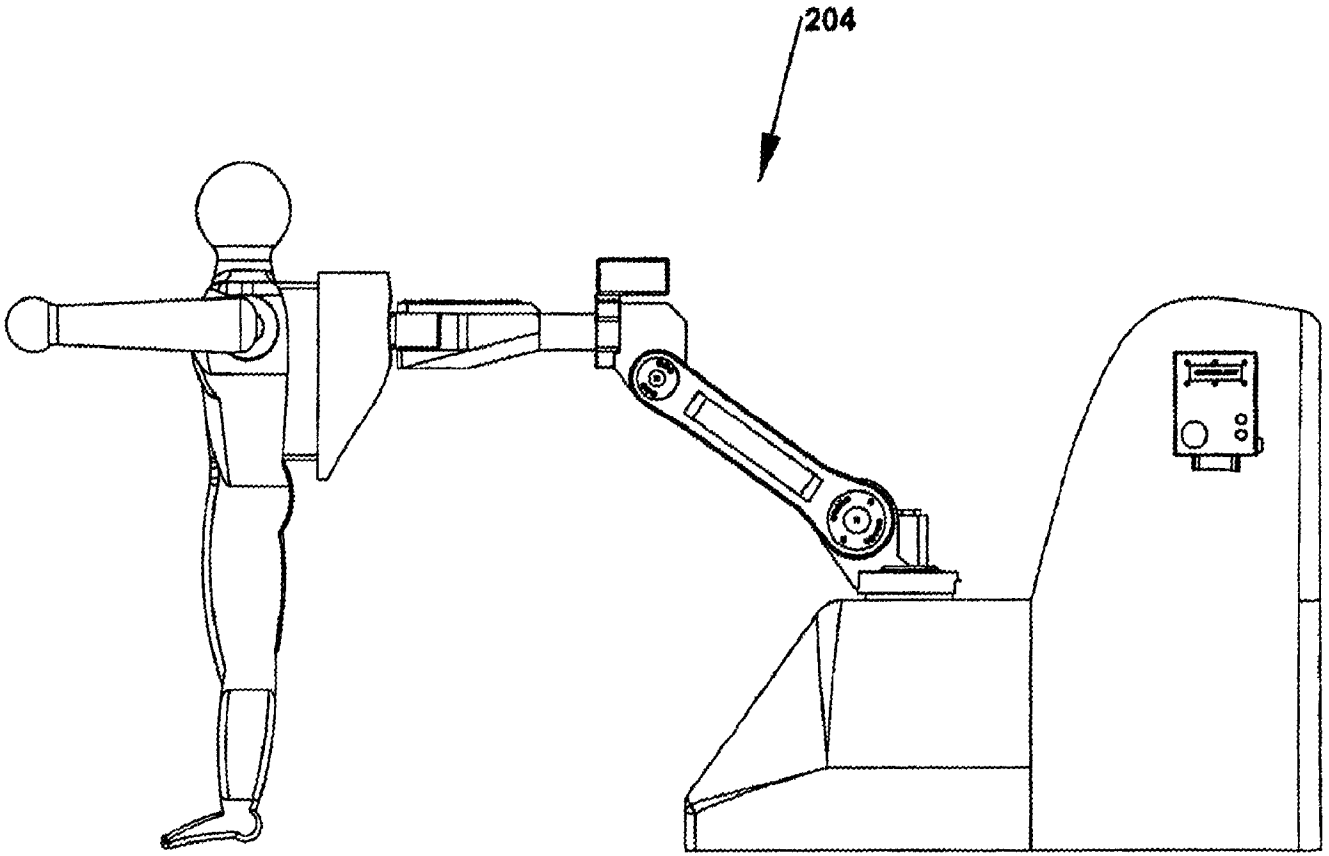
FIG. 5C is a side view of the fifth embodiment showing the manikin in its extended position.
Figure 5D:
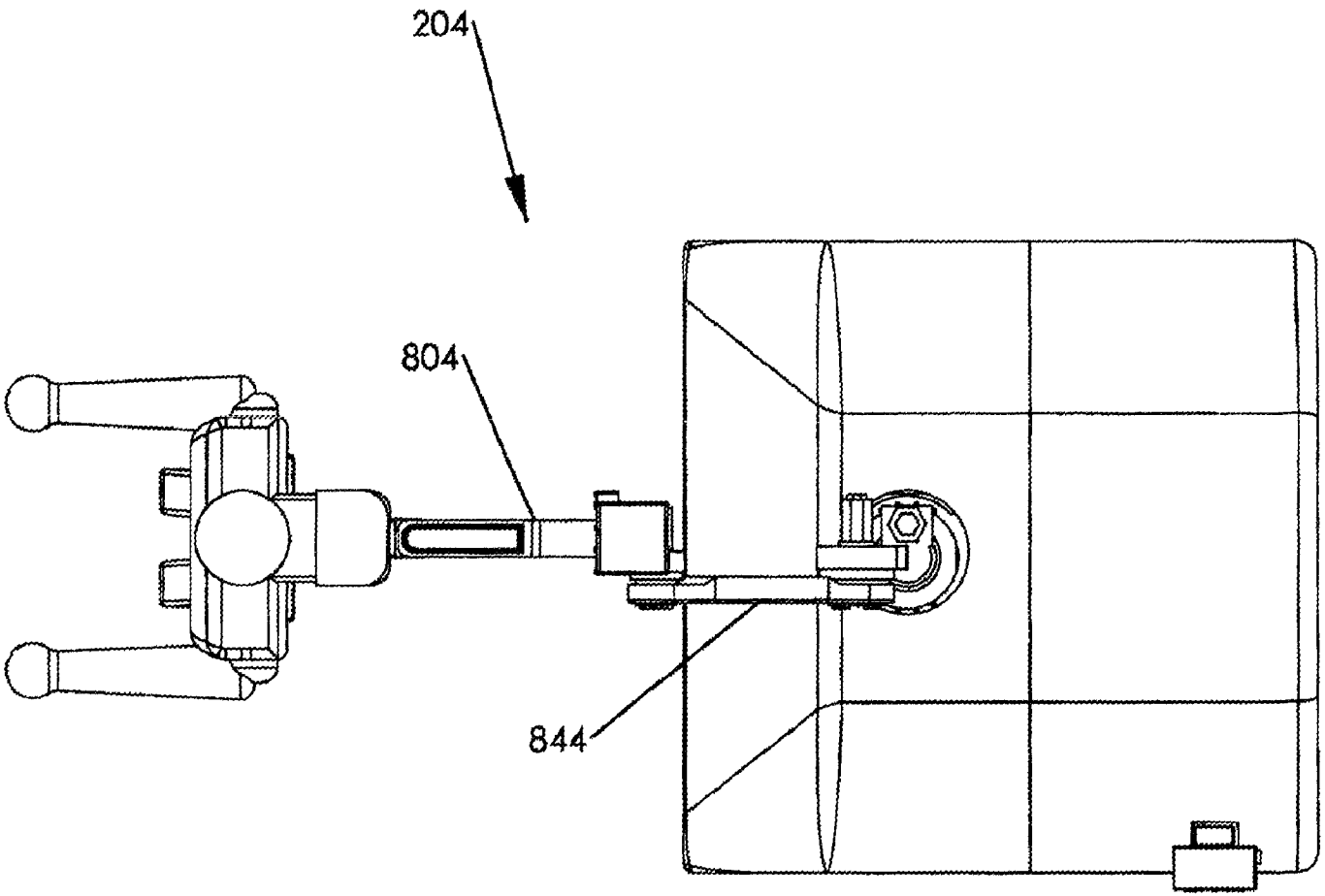
FIG. 5D is a top view of the fifth embodiment.

A fourth embodiment of the practice dummy assembly of the present invention is depicted in FIG. 4A-FIG. 4C generally at 503. While it will be appreciated that the features of this invention might be implemented by increasing the number of manually activated toggle switches, it is preferred that this embodiment be implemented using a disc drive 703. The key operated switch 603 and on/off switches 613 and 623 are positioned on the face of disc drive 703. A slot 713 receives the a disc with the programmed operating instructions for activating the cylinders 343, 353, 363 and 373. In addition, a rocker arm 723 is provided which activates manikin 223 to rotate about a longitudinal x-axis. This fourth embodiment has rotational capabilities about all three axes and can translate in two mutually orthogonal directions. It is anticipated that the disc drive 703 can be overridden by a manually actuated remote control which an operator can utilize.

A fifth embodiment of the practice dummy assembly of the present invention is depicted in FIGS. 5A-5D generally at 204. In this embodiment manikin 224 is attached to horizontal arm 804 which may be rotated about the x-axis by gear 814 on arm 804 which is engaged by gear box 824. The bearing box 834 about which arm 804 rotates, is mounted on robotic arm 844. Robotic arm 844 is mounted on a rotational base 854 for rotation about a z-axis. Both ends of robotic arm 844 provide the rotation about the y-axis and, when rotated together, extend manikin 224 a distance of up to 3 feet (FIG. 5C), by way of example, not limitation. The actual thrust distance for manikin 224 will depend on the length of robotic arm 844.

Figure 6:
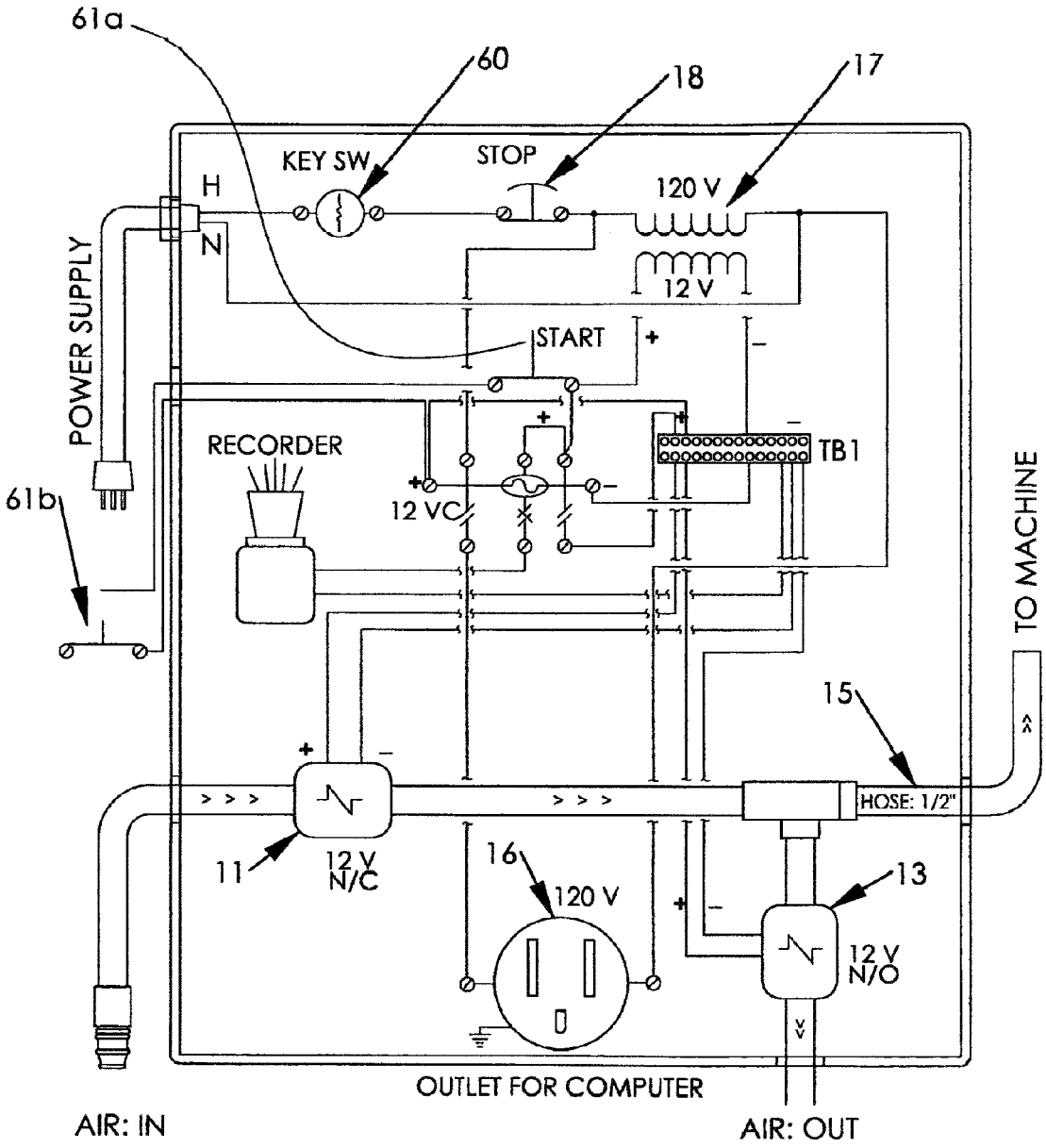
FIG. 6 is a schematic diagram of the control circuitry used in the practice dummy of the present invention.

An activation circuit which can be utilized with any of these five embodiments (as well as a large variety of alternate uses), is depicted in FIG. 6. There are safety issues involved with the operation and use of the practice dummy of the present invention. Accordingly, as a first line of protection, the key switch 60 must be activated for the electrical circuit to be energized. Secondly, a dual-lockout switch system is employed that requires simultaneous activation. The on switch 61*a* on console 50 must be simultaneously engaged/depressed with a remote switch 61*b*. Remote switch 61*b* may be mounted on a portion of the housing shroud 44 or on a cable, as long as the cable is too short to allow sufficient proximity to switch 61*a* to permit actuation by a single individual. When the electrical circuit is energized, three things happen. First, a prerecorded message is activated to play through speakers mounted within the housing. This message will include a warning/disclaimer on the use of the apparatus as well as possible instructions on proper usage thereof. Secondly, power is sent to a solenoid which operates normally closed valve 11 to move it to a normally open position. Thirdly, a second solenoid which operates normally open discharge valve 13 moves it to a normally closed position. Pressurized pneumatic fluid flows from first and second storage tanks 42*a*, 42*b* to the various cylinders associated with manikin 22 through hose 15. An electrical outlet 16 can be provided for a compressor to plug into for pressurizing the storage tanks 42*a*, 42*b*. Alternatively, a compressor can be hardwired into the unit to ensure that it is properly sized for the particular size assembly 20.

Each of the valves are 12v devices. Accordingly, the 120v wall supply is processed through transformer 17 to provide the 12v service needed. The system is preferably 20 amp to accommodate all cylinders of the various embodiments of the practice dummy assembly of the present invention. The circuit can be provided with an emergency stop switch 18 within the reach of the user in case a problem arises requiring immediate disengagement. Whether the emergency stop switch 18 is activated or key switch 60 is utilized, power is cut to the solenoids operating normally closed valve 11 and normally open 13 allowing them to revert to their normal positions. This cuts off the flow of pressurized pneumatic fluid through hose 15 allowing the residual pressure to vent through discharge valve 15. While the actuation circuit has been described in conjunction with pneumatic fluid, it will be appreciated that the circuit would work equally well with a hydraulic or hybrid (pneumatic over hydraulic) system.

Various changes, alternatives, and modifications will become apparent to a person of ordinary skill in the art after a reading of the foregoing specification. It is intended that all such changes, alternatives, and modifications as fall within the scope of the appended claims be considered part of the present invention.

We claim:

1. An activation circuit for use in energizing a practice dummy for martial arts and the like, said activation circuit comprising a) a key switch for energizing said activating circuit;

b) a first enabling switch positioned on a control panel for activation by an operator;

c) a second enabling switch which must be simultaneously activated with said first enabling switch to energize said activation circuit, said second enabling switch being remotely positioned from said first switch whereby a second individual must be present to enable simultaneous activation of said first and second enabling switches;

d) a first solenoid operating a normally closed valve in a fluid circuit, said first solenoid operative by said simultaneous activation to move said normally closed valve to an open position.

2. The activation circuit of claim 1 wherein operation of said key switch triggers broadcast of a prerecorded warning/disclaimer message.

3. The activation circuit of claim 1 further comprising a second solenoid operating a normally open valve in said fluid circuit, said second solenoid operated by said simultaneous activation to move said normally open valve to a closed position.

4. An activation circuit for use in energizing a practice dummy for martial arts and the like, said activation circuit comprising a) a key switch for energizing said activating circuit;

b) a first enabling switch positioned on a control panel for activation by an operator;

c) a second enabling switch which must be simultaneously activated with said first enabling switch a second step to energize said activation circuit, and thereby energizing said practice dummy said second enabling switch being remotely positioned from said first switch whereby a second individual must be present to enable simultaneous activation of said first and second enabling switches;

d) a first actuator operating a normally closed switch in a circuit, said first actuator operative by said simultaneous activation to move said normally closed switch to an open position.

* * * * *